US008333304B1

(12) United States Patent
Haage

(10) Patent No.: US 8,333,304 B1
(45) Date of Patent: Dec. 18, 2012

(54) SELECT-A-SPRAY

(76) Inventor: Gregory A. Haage, Golden Valley, MN (US)

( * ) Notice: Subject to any disclaimer, the term of this patent is extended or adjusted under 35 U.S.C. 154(b) by 100 days.

(21) Appl. No.: 13/019,115

(22) Filed: Feb. 1, 2011

(51) Int. Cl.
*B65D 83/24* (2006.01)
*B65D 83/22* (2006.01)
*B65D 83/16* (2006.01)
*B65D 83/14* (2006.01)

(52) U.S. Cl. ..... 222/402.14; 222/41; 222/43; 222/48; 222/402.11; 239/71; 239/337

(58) Field of Classification Search ..... 222/23, 222/31, 41, 43, 45, 47–50, 153.11, 153.12, 222/394, 402.1, 402.11, 402.13, 402.14, 222/402.17; 239/71, 73, 302, 337, 390, 391, 239/537, 541, 583
See application file for complete search history.

(56) References Cited

U.S. PATENT DOCUMENTS 2,598,308 A 5/1952 Samuels et al.
2,887,273 A 5/1959 Anderson et al.
3,083,872 A * 4/1963 Meshberg ..... 239/73
3,088,679 A 5/1963 Ford
3,178,077 A 4/1965 Benedetto
3,180,536 A 4/1965 Meshberg
3,284,007 A 11/1966 Clapp
3,305,144 A 2/1967 Beres et al.
3,363,968 A 1/1968 Williams
3,387,911 A 6/1968 Focht
3,632,024 A 1/1972 Usen
3,703,994 A * 11/1972 Nigro ..... 239/397
3,721,423 A 3/1973 Shay
3,729,120 A 4/1973 Sette et al.
3,795,350 A * 3/1974 Shay ..... 222/402.17
3,795,366 A * 3/1974 McGhie et al. ..... 239/397
3,804,296 A * 4/1974 Webster ..... 222/48
3,844,448 A 10/1974 Sette
3,848,778 A 11/1974 Meshberg
3,860,149 A 1/1975 Hagianis
3,863,816 A * 2/1975 Focht ..... 222/402.17
3,894,665 A 7/1975 Swenson
4,065,036 A 12/1977 Kirk, Jr.
4,440,325 A 4/1984 Treuhaft et al.
4,542,837 A 9/1985 Rayner
4,773,567 A 9/1988 Stoody
5,027,986 A 7/1991 Heinzel et al.
5,110,231 A 5/1992 Monteith et al.
5,337,926 A 8/1994 Drobish et al.
5,385,303 A 1/1995 Gosselin et al.
5,540,359 A 7/1996 Gobbel
5,639,026 A 6/1997 Woods
5,957,337 A 9/1999 Bettison, Jr.
5,971,230 A 10/1999 Tanaka
(Continued)

*Primary Examiner* — Darren W Gorman
(74) *Attorney, Agent, or Firm* — Albert W. Watkins

(57) ABSTRACT

A spray control device for aerosol cans is provided having three or more dispensing positions. The positions in the preferred embodiment include "automatic" for continuous spray, "manual" for normal push-button control, and "off" to prevent spraying. Adjustment between the various positions is achieved by rotation of a centrally located, floating spray button device that nests on top of an aerosol can. The central spray button device floats within a can coupling ring to accommodate any misalignment between the spray control device and spray can, and movement of the central spray button device is guided by a pin and track combination for predictable and repeatable control over paint or other fluid application. A guide ring is press-fit into the can coupling ring, and both act as a part of the guide track for the central spray button device. The guide ring may optionally be removable to permit complete disassembly and cleaning.

20 Claims, 8 Drawing Sheets

U.S. PATENT DOCUMENTS

| | | | |
|---|---|---|---|
| 6,029,862 | A | 2/2000 | Jones |
| 6,062,432 | A | 5/2000 | Estrada |
| 6,126,044 | A | 10/2000 | Smith |
| 6,345,775 | B1 | 2/2002 | Purvis, II et al. |
| 6,349,854 | B1 | 2/2002 | Bierend et al. |
| 6,382,527 | B1 | 5/2002 | Dukes et al. |
| 6,446,842 | B2 | 9/2002 | Stern et al. |
| 6,536,633 | B2 | 3/2003 | Stern et al. |
| 6,564,977 | B2 | 5/2003 | Uemura et al. |
| 6,655,607 | B2 | 12/2003 | Vazquez |
| 6,758,373 | B2 | 7/2004 | Jackson et al. |
| 6,866,165 | B2 | 3/2005 | Heathcock et al. |
| 6,874,663 | B2 | 4/2005 | Scheindel |
| 6,877,643 | B2 | 4/2005 | Schneider |
| 6,896,205 | B2 | 5/2005 | Purvis, II et al. |
| 6,899,253 | B2 | 5/2005 | Uemura et al. |
| 6,926,172 | B2 | 8/2005 | Jaworski et al. |
| 6,932,244 | B2 | 8/2005 | Meshberg |
| 6,971,552 | B2 | 12/2005 | Meshberg |
| 7,017,785 | B2 | 3/2006 | Lasserre et al. |
| 2002/0017575 | A1 | 2/2002 | Andrews et al. |

* cited by examiner

SELECT-A-SPRAY

BACKGROUND OF THE INVENTION

1. Field of the Invention

This invention pertains generally to the field of dispensing, and more particularly to a fluid dispenser which includes a securing device maintaining the dispenser in an open, closed, or manually controlled state.

2. Description of the Related Art

The primary tools for applying paint, many which have been used by homeowners for centuries, include brushes, rags, cloth and even woolen or fur applicators. When painting a small-to-mid size surface, such as a room wall or the like, such techniques have always been reasonably economical. In fact, there are few homes that are not cluttered with a collection of various pint, quart and gallon paint cans that contain the various paint mixtures of previous painting projects. Often times, there will also be a clutter of various sizes and ages of brushes, frequently stiffened by old paint that was never completely cleaned from the brush prior to storage.

While this approach has been used for a very long time, and is extremely commonplace in the vast majority of homes, the paint can and brush techniques have suffered from a number of undesirable shortcomings. For example, when a project is finished, such as painting a room, whatever quantity of paint remains in the can will most desirably be stored. In the event that at some later date damage occurs to the painted walls or ceiling, theoretically the homeowner may simply repair any physical damage and then re-apply the saved paint. With a high quality paint, this could be years later, and the colors will still be expected to match exactly with the paint that was originally applied. The same theory applies in the case of minor remodeling or redecorating, such as the installation of a new light fixture that covers a slightly different amount of the adjacent wall surface. Unfortunately, the paint stored in ordinary paint cans has a relatively limited shelf life. The air gap present above the liquid paint acts as a large source of oxygen, which invariably leads to a degradation of the paint. Typically, at least the surface layer of the paint will harden and be unsuitable. The amount of paint which is lost to this process is frequently dependent upon some complex combination of how full the paint can is, the ingredients of the paint, and how long the can is stored. Consequently, the homeowner will never know quite what to expect when the can is opened, even only a few months later. Worse, even if there is still some usable paint in the can, it is well-known that the pigments that are contained in most paints are more dense than the base. When the paint is first stored, the pigments consequently settle out, often before much hardening of the surface has occurred. Consequently, when the homeowner strips the hardened surface off of the paint and then mixes the remaining usable paint in the ordinary manner, the concentration of pigments has unintentionally been increased, potentially affecting the match between the original paint and the paint now remaining in the can.

Not only is paint difficult to store in ordinary paint cans and buckets, but used brushes are equally difficult to store. A high quality brush has the unique ability to hold a great deal of paint within the interstices between the bristles. As paint is applied to a surface, the brush tip will desirably draw paint gradually from the bristles, and the brush may be used for several strokes before requiring another dip into the paint. Unfortunately, the very characteristic which makes a brush more desirable for the application of paint also makes the brush somewhat more difficult to clean. Since the paint is held within the bristle interstices, there is a tendency for the brush nearest to the handle to dry along the outer surfaces that are exposed to the air. Removal of this paint can be difficult. But, in addition to getting the dried paint off, there will also be a large amount of unused paint retained within the brush. Consequently, whether the paint is water-based or oil-based, the brush will require a large volume of appropriate cleaner or solvent just to remove the remaining wet paint that is held in the brush. This is, of course, before the dried-on paint can be removed. Even with a fairly rigorous cleaning, the brush will almost always still have some paint remaining, and over time and with more use, the brush will harden up and become useless. In the end, a diligent person will spend a great deal of time and cleaner cleaning up a high quality brush, only to still eventually throw the expensive brush away.

Another drawback with the traditional tools and methods of paint application is in the control of the amount of paint applied, and control over the surface finish. Most brush-applied paints are generally relatively thick, to avoid unwanted runs that might otherwise occur on a vertical wall immediately after a brush has been dipped into paint. In addition, thick paint will drip much less from the brush. However, this thicker paint invariably leads to the creation of a pattern of brush strokes that will remain even after the paint is dried. While brush strokes are desired in some instances to add texture, the painter rarely can control this, since thin paints will run and drip, and thicker paints retain the brush stroke. Moreover, with thicker paint the painter must pass the brush over the same area several times to ensure that all of the surface is covered. Otherwise, all too commonly there will be an occasional "streak" where the paint was either applied too thinly or not applied at all. As will also be apparent, the application of thicker paint also results in the consumption of a relatively large amount of paint. Where a color of great contrast is being used to cover another, a thick application may be desired. The converse, where there is little contrast between the two colors, often requires only a relatively thin coat of paint. Unfortunately, with a brush there is little control available.

Yet another drawback comes when a non-traditional surface is to be painted. For example, machinery such as automobiles, lawn equipment, wheel barrows and wagons, metal railings, stone, concrete, brick and mortar, and many other surfaces may require painting from time to time around a typical house. In some of these cases, a very thin and smooth coat of paint is highly desirable, such as on a typical smooth metal surface. In contrast, a very thick coat of paint is often desirable on a very rough surface, such as on concrete or bricks and mortar. Again, with a brush there is little control available.

There have been a number of well-received inventions more recently which have overcome some of the foregoing deficiencies of traditional painting. For example, there have been a number of new paint applicators that have been developed that give a homeowner more control over the thickness, and even the texture, of a coat of paint. Among these applicators are the various paint rollers and paint pads that have various "naps" or applicator surfaces that will hold more or less paint, and may be designed to form varying textures during application. Nevertheless, these various applicators still rely upon paint storage cans and interstices of one form or another within the applicator. In addition, and in spite of the many new applicators that have been developed, homeowners still invariably resort to brushes to form at least a part of the set of painting tools used for the relative simplicity and control found therein. Further compounding the problem is the knowledge that, when it comes to non-traditional surfaces, many of these more modern tools that are used to apply coats of paint are unsuited to these non-traditional surfaces. While improved can seals and geometries have also been developed, these fail to resolve the problems of long term storage within a paint can.

Commercial paint sprayers overcome many limitations of prior art applicators and typically enable an operator to apply large volumes of paint rapidly, with substantial control over the fineness and density of the spray mist. These sprayers may simply use pressurized air, or may combine additional techniques such as electrostatic attraction and the like to further improve the control and quality of spray. Unfortunately, these commercial sprayers are generally quite expensive, often require special knowledge and training to operate, require more care to clean and store than an ordinary homeowner will provide, and require storage space that is already scarce in most homes. Consequently, few homeowners would consider investing in a commercial sprayer. Finally, these commercial paint sprayers rely upon cans or pails of paint which present the same problems with storage and aging as already described herein above.

In order to offer homeowners, hobbyists and the like a greater range of flexibility than paint rollers, brushes, pads, and the like, and to more closely emulate the quality obtained by a commercial paint sprayer, manufacturers have developed various paint spray cans over the last half-century that combine paint with propellant in a self-contained can. These spray cans have met with much commercial success, since they provide the homeowner a high quality paint spray without the burden of large storage space, high initial purchase prices, and maintenance. The homeowner or hobbyist will simply spray the desired paint, and then typically tilt the can upside down to release a small amount of propellant without paint, to clear the nozzle. Then the spray cap is replaced, and the can may be stored for great lengths of time. With more modern valves and propellants, such paint cans may be stored for many years and then re-used with results in both color and quality unchanged by time.

However, these spray cans differ from the commercial sprayers in several important and undesirable ways. Spray cans are practically limited to operation in either an on or off mode, and the user cannot readily control or vary the amount of spray discharged. The pattern produced by the nozzle, the rate of discharge, and the desired particle size are each selected by the paint manufacturer, and none are readily changed or controlled by the painter. In addition, and as an undesirable side-effect of the ease of use of a spray can, when a child gains access to the can much harm may be done.

A number of artisans have worked with and improved upon the basic spray can construction, the teachings of each reference identified herein below which will be understood to be incorporated herein by reference. Representative of these is U.S. Pat. No. 2,598,308 by Samuels et al, entitled "Controllable Spray Dispenser", which illustrates a spray device with three positions, "Automatic Continuous Spray", "Push Button Spray", and "Locked Position". This apparatus comprises a special cap that fits on an aerosol can, where the cap is made to slide upon a protruding nozzle. A slot in the cap causes the cap to slide up or down respective to the central valve. When the cap is in the locked rotational position, the cap will hit the can to prevent the central valve from being activated. When the cap is in the automatic position, a projection hits the rubber diaphragm of the valve because of force exerted between the slot in the cap and the protruding nozzle, activating the valve. It does not, however, disclose the concept of a floating index, a pin guided track for spray selection, and it will not work with modern spray cans.

U.S. Pat. Nos. 3,729,120 by Sette et al, entitled "Child-proof relockable actuator overcap," and 3,844,448 entitled "Valve actuating safety cap assembly for pressurized dispensers" disclose a two-part cap that provides locking in a spray cap. While the caps illustrated therein provide adjustable spray settings, the cap is not durable, owing to the geometries of construction, and will become contaminated with paint on the top surface due to splatter and the like. Finally, since the interior and exterior sections must rotate relative to each other and there is no manual access to the interior section, the cap is not readily manually adjusted and there will be a tendency for the interior and exterior to rotate together.

U.S. Pat. No. 3,387,911 by Focht discloses a pin guided track, in association with a dispenser, for dispensing such materials as stain removers, hair coloring foam, shoe polish, dye, cleaning agents, shaving foam, and the like. The track is useful for controlling the amount of product being dispensed, but fails to provide any accommodation for factory or after-market misalignment. Another configuration is shown in U.S. Pat. No. 6,029,862 by Jones, entitled "Selectable Rate Actuator for Spray Cans", which describes a commonly sold trigger attachment for aerosol cans that can be operated to lock the trigger from activating the aerosol spray, lock the trigger in an activated position for continuous spray, or unlock the trigger for short bursts of spray controlled by a spring assembly. Unfortunately, the Jones invention does not balance the can well, leading to significant operator fatigue. Further, the Jones invention does not readily store directly with the spray can, mandating either repeated assembly and disassembly from a spray can or causing substantial interference with the storage and access of individual spray cans.

Other patents disclosing locking spray devices have also been disclosed, including U.S. Pat. No. 3,632,024 by Usen; U.S. Pat. No. 3,721,423 by Shay; U.S. Pat. No. 3,860,149 by Hagianis; U.S. Pat. No. 5,957,337 by Bettison; U.S. Pat. No. 4,773,567 by Stoody; U.S. Pat. No. 4,542,837 by Rayner; U.S. Pat. No. 5,971,230 by Tanaka; U.S. Pat. No. 4,065,036 by Kirk Jr; U.S. Pat. No. 6,349,854 by Bierend et al; and U.S. Pat. No. 6,126,044 by Smith. Patents that disclose centrally rotating control of spray nozzles on aerosols include U.S. Pat. No. 5,385,303 by Gosselin et al; U.S. Pat. No. 6,345,775 and U.S. Pat. No. 6,896,205 by Purvis II et al.

Other patents of interest include U.S. Pat. No. 2,887,273 by Anderson et al; U.S. Pat. No. 3,178,077 by Benedetto; U.S. Pat. No. 3,284,007 by Clapp; U.S. Pat. No. 3,848,778 by Meshberg; U.S. Pat. No. 3,894,665 by Swenson; U.S. Pat. No. 4,440,325 by Truehaft et al; U.S. Pat. No. 3,088,679 by Ford; U.S. Pat. No. 3,180,536 by Meshberg; U.S. Pat. No. 3,305,144 by Beres et al; U.S. Pat. No. 3,363,968 by Williams; U.S. Pat. No. 5,027,986 by Heinzel et al; U.S. Pat. No. 5,110,231 by Monteith et al; U.S. Pat. No. 5,337,926 by Drobish et al; U.S. Pat. No. 5,540,359 by Gobbel; U.S. Pat. No. 5,639,026 by Woods; U.S. Pat. No. 6,062,432 by Estrada; U.S. Pat. No. 6,382,527 by Dukes et al; U.S. Pat. No. 6,446,842 and U.S. Pat. No. 6,536,633 by Stern et al; U.S. Pat. No. 6,564,977 by Uemura et al; U.S. Pat. No. 6,655,607 by Vazquez; U.S. Pat. No. 6,758,373 by Jackson et al; U.S. Pat. No. 6,866,165 by Heathcock et al; U.S. Pat. No. 6,874,663 by Scheindel; U.S. Pat. No. 6,877,643 by Schneider; U.S. Pat. No. 6,899,253 by Uemura et al; U.S. Pat. No. 6,926,172 by Jaworski et al; U.S. Pat. No. 6,932,244 and U.S. Pat. No. 6,971,552 by Meshberg; and U.S. Pat. No. 7,017,785 by Lasserre et al.

In spite of the substantial consideration and development that has occurred through the years, these patents are deficient in being capable of adequate operation with modern spray cans, in occupying minimal space, in functioning with the simplicity of a standard spray can, and in other manners that will become apparent.

SUMMARY OF THE INVENTION

In a first manifestation, the invention is a selectable spray system. The system includes a spray container having fluid and propellant contained within. A dispersion nozzle is coupled through a conduit to the fluid and propellant. A valve operatively controlled through displacement of the conduit relative to the spray container variably restricts the flow of fluid and propellant from within the spray container to the dispersion nozzle. A can coupling ring has an outer perimeter and an interior surface defining an interior space, and is coupled rigidly to the spray container. An index engages and adjusts the conduit to control the valve, in turn adjusting flow. The index floats relative to the spray container sufficiently to accommodate minor misalignment therewith and permit the conduit to couple with the spray container. The index is circumscribed by the can coupling ring. At least one index pin protrudes radially from the index. A selector guide ring is affixed to the can coupling ring. At least one gap defined between the selector guide ring and can coupling ring captures the pin and thereby limits changes in distance between index and can coupling ring. The gap extends through an arc about the conduit and has at least two distinct distances from the spray container along the arc.

In a second manifestation, the invention is a spray valve operative with a fluid containing, propellant charged container to control the dispensing of fluid therefrom. The spray valve has a first locked state preventing unintentional release of fluid and propellant and a second state controlling dispensing of the fluid. The valve has a press-fit base which is rigidly snapped onto a top of the container. A dispensing conduit is coaxially aligned with a height of the container and concentric with the press-fit base. A selector guide ring is rigidly press-fit into the press-fit base and has a plurality of ledges on a surface distal to the container top. A plurality of ledges are formed into the press-fit base, generally complementary to the selector guide ring ledges and slightly displaced angularly about the dispensing conduit. The press-fit base ledges and selector guide ring ledges define a plurality of guide paths within the press-fit base. A plurality of pins are operative to traverse the plurality of guide paths. An alignment disc captures the dispensing conduit and plurality of pins for joined movement with each. The alignment disc is further rotatable within and captured between the press-fit base and the top of the container, with rotation in a first direction driving the dispensing conduit into the container and rotation in a second direction opposite to the first direction withdrawing the dispensing conduit from the container.

OBJECTS OF THE INVENTION

Exemplary embodiments of the present invention solve inadequacies of the prior art by providing a spray control device for aerosol cans having three or more dispensing positions. The positions in the preferred embodiment include "automatic" for continuous spray, "manual" for normal push-button control, and "off" to prevent spraying. Additional intermediate or continuously variable positions may also be provided. These positions are achieved by the rotation of a central spray button device that nests on top of an aerosol can. The central spray button device floats within a can coupling ring to accommodate any misalignment between the spray control device and spray can, and movement of the central spray button device is guided by a pin and track combination for predictable and repeatable control over paint or other fluid application. A guide ring is press-fit into the can coupling ring, and both holds the central spray button device and also acts as one part of the guide track. When necessary, and if so constructed, the guide ring may be removed to permit complete disassembly and cleaning.

A first object of the invention is to provide an apparatus for varying the dispense rate of a spray can. A second object of the invention is to provide the dispense rate control apparatus in a package which is both low-cost and intuitive to use. Another object of the present invention is to provide the dispense rate control apparatus in a package which facilitates storage within the ordinary footprint of the spray can to which the apparatus is attached. A further object of the invention is to provide flexibility of use and capability from a spray can which more closely resembles capabilities heretofore available only from professional spray equipment. Yet another object of the present invention is to enable both original manufacture integral with a spray can and retrofit of existing cans. A further object of the invention is to ensure that a user will have access to all components that require manipulation, to ensure ease of use. An additional object of the invention is the provision of such an apparatus, which is additionally resistant to solvents such as may be used with the apparatus, and which in at least some embodiments may be readily removed and cleaned.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
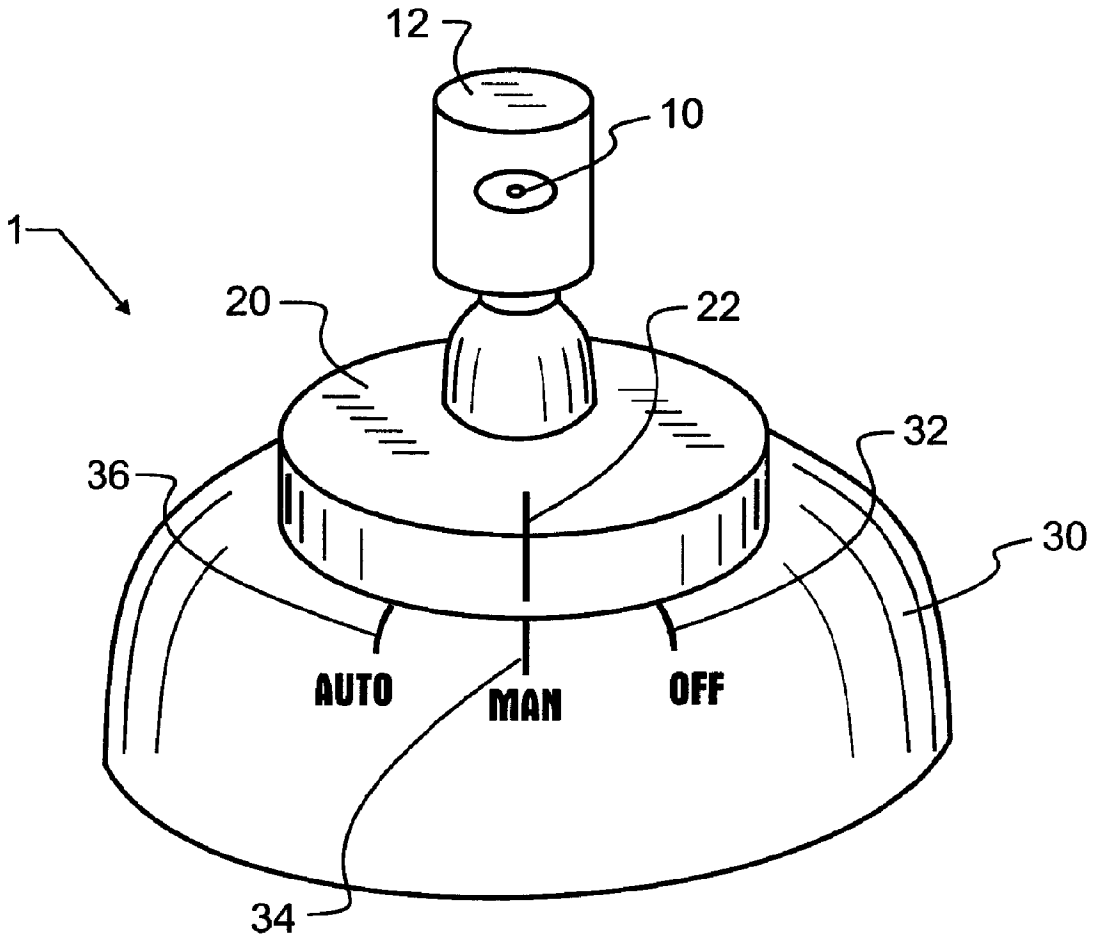
FIG. 1 illustrates a first preferred embodiment spray nozzle operable with a modern paint can which has been designed in accord with the teachings of the invention, from projected plan view looking diagonally down onto the spray nozzle.

In a preferred embodiment of the invention illustrated in FIG. 1, a Select-a-Spray nozzle 1 and associated members are illustrated. As shown in FIG. 1, a spray nozzle 10 is mechanically supported by push button 12. Nozzle 10 serves as the termination of a conduit 14, which is first visible in FIG. 2 and particularly visible in FIG. 3. Conduit 14 is of the type which may be commonly found inserted partially into a spray can, is moved to activate the release of spray from the spray can, and which will additionally transport paint and propellant to nozzle 10 for spraying or dispersion therefrom.

In one alternative embodiment contemplated herein, conduit 14 may be of somewhat larger diameter than a factory or otherwise provided conduit emerging from a spray can. In such instance, conduit 14 will most preferably receive the factory conduit therein in a nesting fashion. By making conduit 14 larger than the factory conduit, there will be little if any flow restriction introduced by the present nozzle 1.

The particular design of conduit 14, nozzle 10, and pushbutton 12 will vary greatly depending upon the particular matter being sprayed and even upon individual manufacturers and their preferences. However, and as will be apparent upon a review hereof, the present invention is well suited to any type of spray container which requires actuator depression to invoke the dispersion of the spray container contents.

Encompassing a portion of conduit 14 is floating member 20, which in the preferred embodiment includes guide line or indicia 22 which indicates the direction of spray emanating from nozzle 10 during use. Circumscribing floating member 20 is a can coupling ring 30. Preferably, and as shown in FIG. 1, can coupling ring 30 is clearly labeled with the various operational modes available in the preferred embodiment, including a locked-off position label 32, a manual mode position label 34, and an automatic mode position label 36. Guide line 22 may be oriented to align with any of the three labels 32-36, and will most preferably activate a spray can to either spray continuously and at full spray rate when guide line 22 is aligned with the "auto" label 36, spray in the standard pushbutton activated manner when guide line 22 is aligned with the "man" label 34, or be locked to not spray even when pushbutton 12 is pressed, when guide line 22 is aligned with the "off" label 32. The method of activation will be more clearly described in relation to FIGS. 2-5 herein below. Contemplated herein is an ability to either have distinct "detents" which encourage guide line 22 to be aligned specifically with each label, or alternatively to design the components such that guide line 22 may be adjusted to continuously vary in rotation relative to each label.

Figure 2:
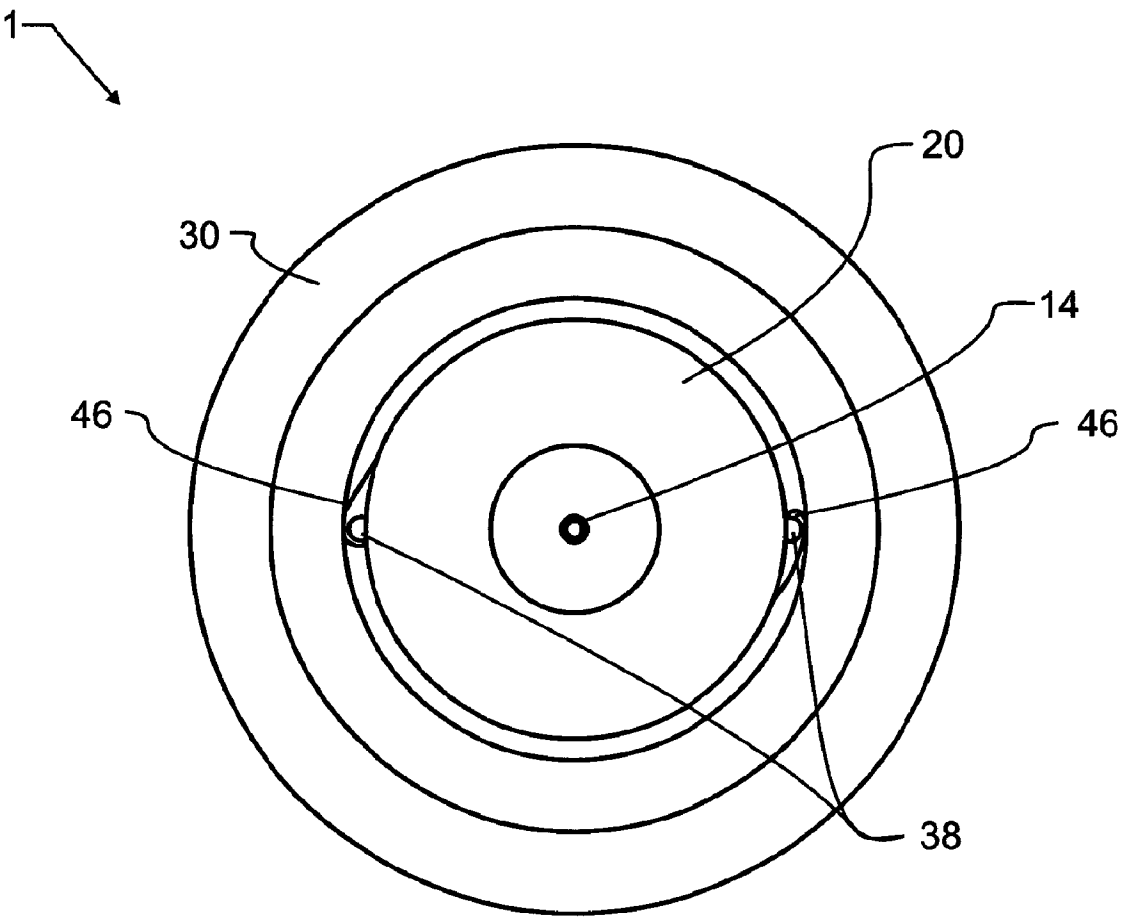
FIG. 2 illustrates the preferred embodiment spray nozzle of FIG. 1 from bottom plan view.

FIG. 2 illustrates the preferred embodiment Select-a-Spray nozzle 1 of FIG. 1 from bottom plan view. In the center of the figure is conduit 14. Floating member 20 surrounds conduit 14, though leaving a portion of conduit 14 extending out of the page as is best visible, for example, in FIG. 3. At the time of assembly of the preferred embodiment Select-a-Spray nozzle 1, floating member 20 will be inserted into can coupling ring 30 from this bottom direction, and will nest therein adjacent a top surface of can coupling ring 30 which, as evident from FIGS. 1 and 2, has a slightly smaller inside diameter than the outside diameter of floating member 20. Before, during or after this nesting of floating member 20 within can coupling ring 30, a plurality of retaining pins 38 are placed. Retaining pins 38 are most preferably placed with adequate clearance to permit floating member 20 to move up, down and angularly with respect to can coupling ring 30. The amount of movement should be sufficient to accommodate several different desirable intrinsic characteristics. The first of these is to best permit the installation of can coupling ring 30 onto a can even where there is a slight angular offset therebetween. In other words, if can coupling ring 30 is not perfectly concentric about the top of a spray can such as can 50 of FIG. 5, and were there no flexibility between floating member 20 and can coupling ring 30, then conduit 14 might not properly align within the spray can opening. By permitting a small amount of angular offset between floating member 20 and can coupling ring 30, minor misalignment will be readily accommodated. In addition, controlled rotation will effect the changes of actuation of the spray can, as will be described herein below. Consequently, some relative motion is most preferred, and not provided for in the prior art.

The use of pins 38 is preferred herein for retaining floating member 20 in can coupling ring 30 while permitting desired relative motion, but those skilled in the art will recognize that there will be a myriad of comparable mechanical analogues which may be utilized to obtain the desired anchoring and securement. The specific selection of suitable components will be determined at the time of design or fabrication. In the preferred embodiment, the particular fabrication methods and materials led to the selection of pins 38.

Figure 3:
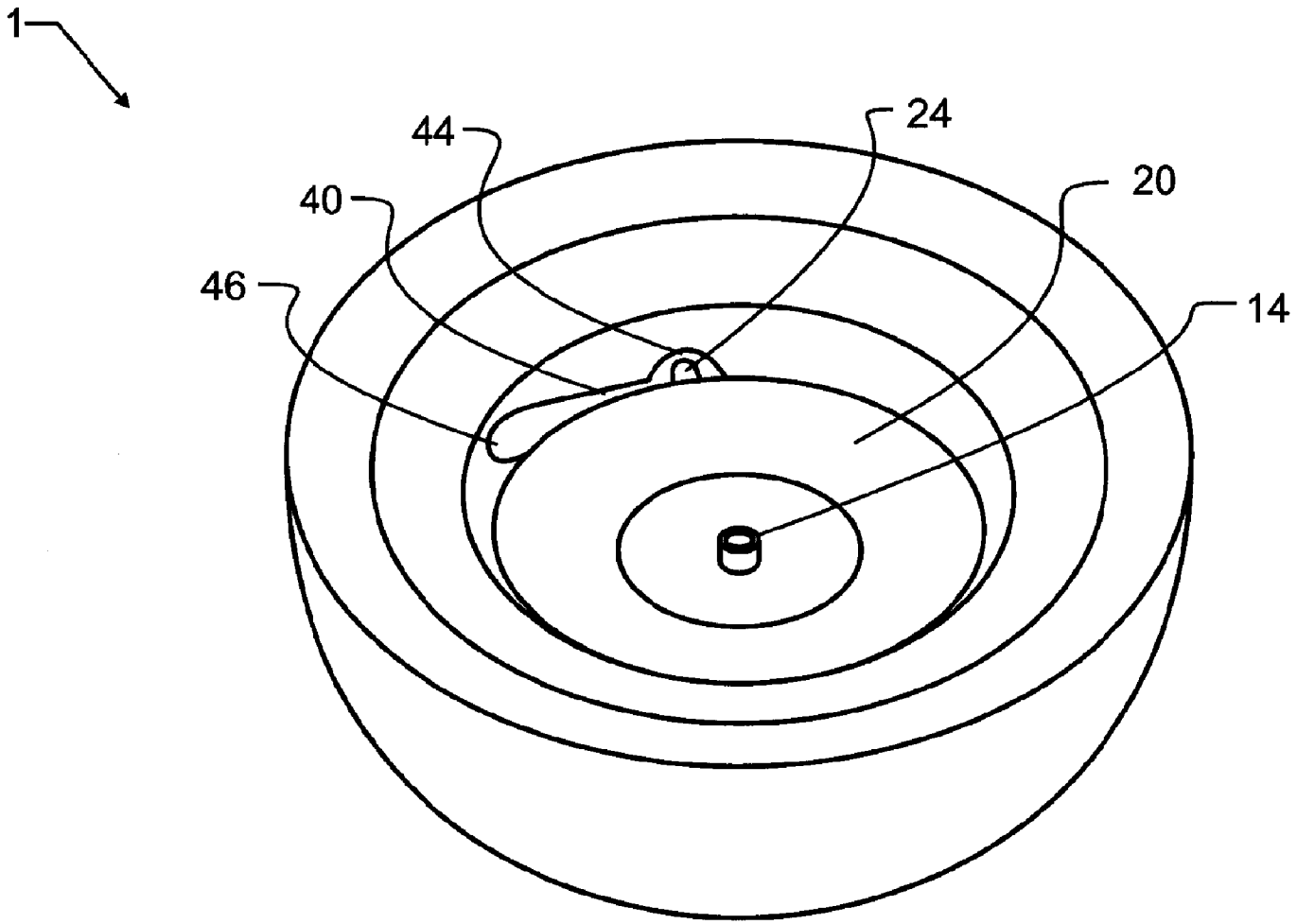
FIG. 3 illustrates the preferred embodiment spray nozzle of FIG. 1 from projected view showing a generally bottom orientation looking into the interior mechanisms of the preferred embodiment spray nozzle.
Figure 4:
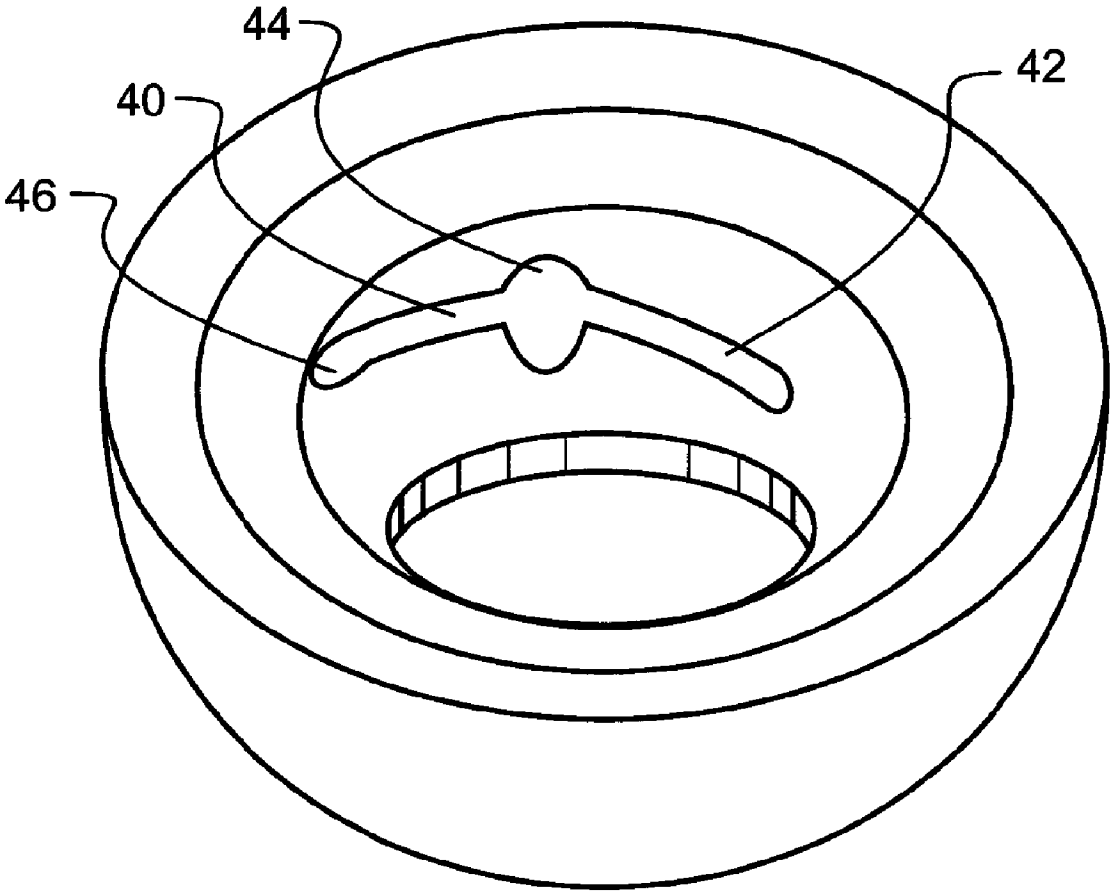
FIG. 4 illustrates the preferred embodiment spray nozzle of FIG. 1 from projected view showing a generally bottom orientation looking into the interior mechanisms of the preferred embodiment spray nozzle, but with the floating nozzle removed.

FIGS. 2-4 each illustrate the preferred embodiment Select-a-Spray nozzle 1 of FIG. 1 from a generally bottom orientation looking into the interior mechanisms of the preferred embodiment spray nozzle. As is evident in these figures, a small indexing pin 24 protrudes radially beyond the balance of the radial perimeter of floating member 20, and into indexing groove 40 cut into can coupling ring 30. Indexing groove 40 has three distinct indexing points, identified as 42, 44 and 46 in the figures, which correspond with labels 32, 34, 36 of FIG. 1. As may be seen, indexing point 44 represents the manual position, and has a large vertical width, which in turn permits floating member 20 to travel vertically a larger distance than permitted in the remaining indexing positions. Most preferably, this vertical opening is sufficient to permit vertical travel equal to or greater than that required for fully off to fully on operation of the spray can. Since, in the preferred embodiment, the spray can is of the pushbutton type, at least the amount of vertical travel permitted by the spray will preferably be permitted by Select-a-Spray nozzle 1.

When floating member 20 is rotated relative to can coupling ring 30, then indexing pin 24 will similarly move within indexing groove 40. When rotated to correspond to indexing point 46, which is the automatic position, groove 40 will guide indexing pin 24 closer to the bottom opening of can coupling ring 30. Said another way, interaction between groove 40 and indexing pin 24 will force conduit 14 farther into an opening 54 in exemplary can 50 illustrated in FIG. 5. This will cause spray to pass through conduit 14 and be emitted from spray nozzle 10, without the need for any manual pressure to be applied to pushbutton 12. In light of the present design, it will be recognized that when an operator wishes to spray for an extended period of time, a simple twist of floating member 20 to align guide line 22 with "auto" label 36 will cause spray to be continuously emitted, unless or until the operator again twists floating member 20 or can 50 runs out of propellant.

When floating member 20 is rotated in an opposite direction, to align guide line 22 with "off" label 32, groove 40 will guide indexing pin 24 farther from the bottom opening of can coupling ring 30, or will, at a minimum, narrow sufficiently to prevent floating member 20 from being moved towards can 50. In this instance, no spray may be emitted from nozzle 10, regardless of whether force is applied to pushbutton 12 or not. This then acts as a safety lock, to prevent accidental or unintentional emission of spray, or unwanted use by a young child.

The geometry of groove 40 determines the movement of floating member 20. Consequently, if as illustrated in FIG. 3 groove 40 has small upwardly extending bulges at each indexing point, the resilience of the spray can valve will drive conduit 14 and consequently floating member 20 upwards into those bulges. This geometry and reaction combine to form manual detents which provide tactile indication of a particular rotary setting, and additionally tend to resist accidental rotation therefrom.

In an alternative or an optional co-feature, groove 40 may be relatively gently sloped or be made of a material which tends to frictionally interact with guide indexing pin 24, such that floating member 20 may be rotationally positioned and will tend to stay in an operator-selected position solely due to the static friction between components. In such instance, the upwardly extending bulges at each indexing point may be optional, though still preferred for the manual feedback that they provide.

While described as separate components, and depending upon a particular construction or fabrication method or technique, it should be apparent to those skilled in the art upon a reading of the present disclosure that retaining pins 38 and guide indexing pin 24 could be the same component. In other words, the guide pins may serve a dual purpose as retaining pins. Therefore, and again depending upon a particular design, it may be desirable to either fabricate these separately or as a common component.

Figure 5:
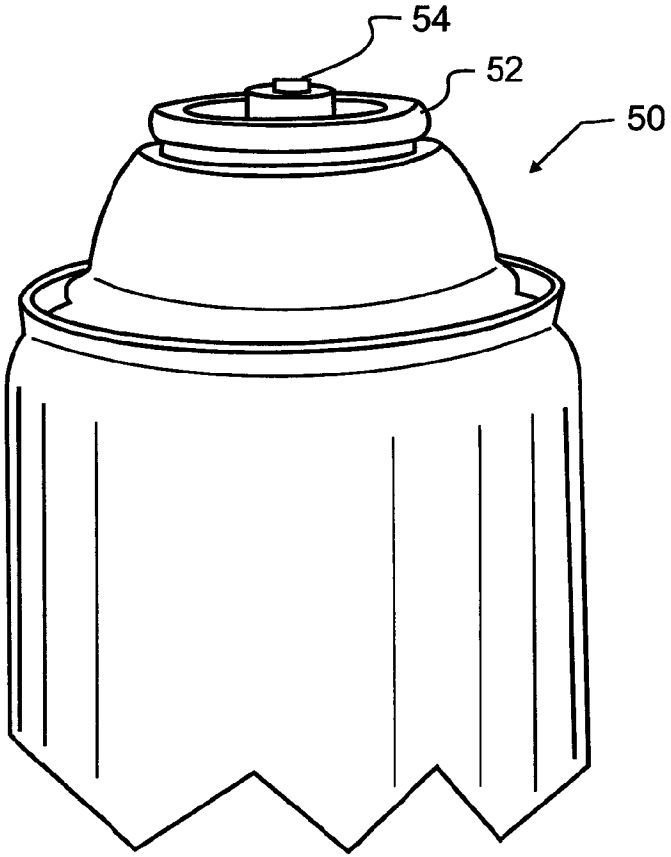
FIG. 5 PRIOR ART
FIG. 5 illustrates a prior art spray paint can suitable for use in further combination with the preferred embodiment spray nozzle of FIG. 1, with the spray nozzle removed, and from front slightly projected view.

As illustrated for exemplary purposes in prior art FIG. 5 from a generally front elevational view, a prior art spray paint can 50 which is suitable for use in combination with the preferred embodiment spray nozzle of FIG. 1 has an opening 54 through which conduit 14 will operatively pass. In preparation for installation of preferred embodiment Select-a-Spray nozzle 1, the existing spray nozzle and conduit have been removed from can 50. Rim 52 serves as an ideal coupling surface to which can coupling ring 30 may engage. This engagement can simply be a friction fit engagement, or there may be additional geometry provided in either Select-a-Spray nozzle 1 or rim 52, such as lips of smaller diameter or the like, which could then be designed to ensure very snug engagement, as may be desired or preferred by a particular designer at design time.

Figure 6:
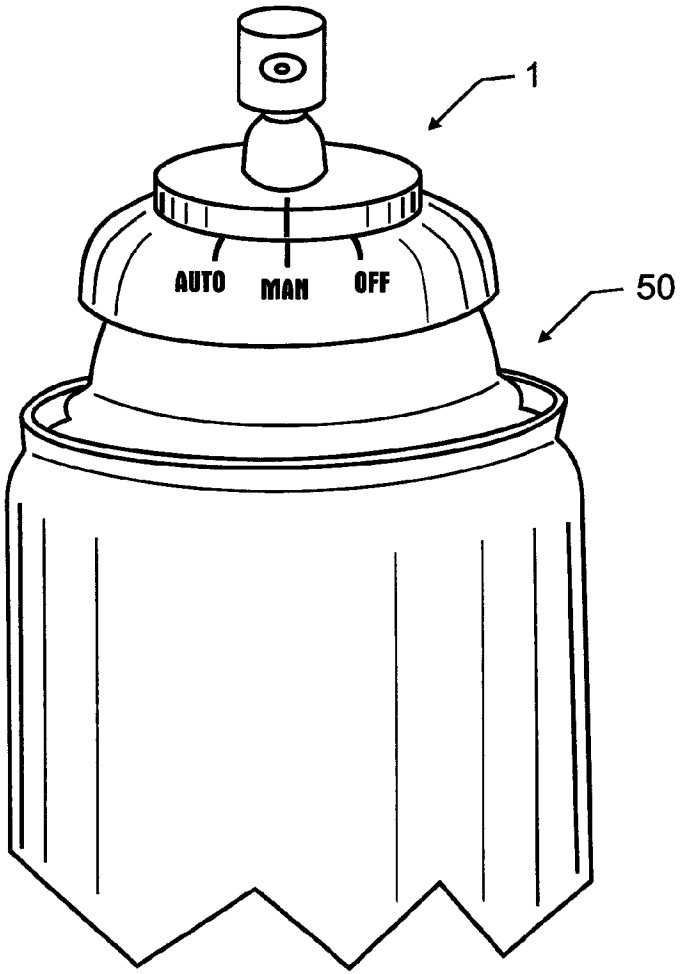
FIG. 6 illustrates the preferred embodiment spray nozzle of FIG. 1 from projected view in further combination with the prior art spray paint can of FIG. 5.

The preferred embodiment spray nozzle 1 is illustrated in further combination with the prior art spray paint can 50 in FIG. 6. Depending upon the dust cover provided with spray can 50, Select-a-Spray nozzle 1 may fit entirely within the dust cover, and so may be stored directly with spray can 50. Alternatively, and as will be recognized, the features illustrated herein may be fabricated directly into a spray can design, and so be implemented without the need for accommodation or retrofitting of prior art cans such as can 50.

From these figures, several additional features and options should become more apparent. First of all, indexing groove 40 may be shaped differently than illustrated herein, to rearrange the orientations between floating member 20 and can coupling ring 30 that are required for the various spray modes. The arrangement of indexing positions 42-46 is preferred owing to the gradual changes in position that are afforded, but indexing groove 40 may be cut with very different geometries for the needs of a particular application. Furthermore, while only three distinct indexing points are illustrated, it should also be apparent that the indexing may be continuously variable as described herein above, consequently permitting an operator to spray in the automatic mode both in the full-on position and alternatively with only partial opening of the spray can. Such continuously variable adjustment may be very desirable for certain applications.

While the use of the guide indexing pin(s) 24 and indexing groove(s) 40 are most preferred, those skilled in the art of mechanical fabrication and guides will also recognize equivalents to these components. Similarly, rather than provide a guide line 22 such as shown in FIG. 1, other types of indicators may also be provided. For exemplary purposes only, and not limiting thereto, a line or groove may be provided directly into the top of pushbutton 12, pushbutton 12 or floating member 20 may have unique indicating geometries or other indicia. Quite simply, any suitable techniques may be used which will help a user recognize the current direction or orientation of floating member 20, which will in turn then indicate the current setting of Select-a-Spray nozzle 1.

Since pushbutton 12 and nozzle 10 are already designed by the Select-a-Spray nozzle 1 to be independent from prior art spray can 50, another conceived combination of features is enabled by the present invention. More particularly, in the prior art can 50, the manufacturer had to decide for a particular spray can exactly what nozzle and spray characteristics to use. This naturally limits both the spray pattern and volumes of paint that may be emitted therefrom, and may also impact the fineness of the mist. Preferably, the present Select-a-Spray nozzle 1 is designed to accommodate the prior art pushbutton 12 and nozzle 10 from prior art can 50 as a replacement for the like component used within Select-a-Spray nozzle 1. So, if desired, a user may use exactly the nozzle chosen by the manufacturer. However, most preferably the user may also remove pushbutton 12 having nozzle 10 from conduit 14, or remove pushbutton 12, nozzle 10 and conduit 14 from floating member 20. In either case, the operator may also be provided with a variety of differing nozzles 10 from which to select the most optimum spray pattern and volume for a given application, particular paint viscosity, and propellant characteristic. From a reading of the present disclosure, those reasonably skilled in the art will be able to select a suitable method of coupling floating member 20 to conduit 14. This may range from semi-permanent or permanent couplings such as adhesive or ultrasonic bonding or welding to removable and resizable couplings or methods of engagement, such as the provision of variably dimensioned o-rings or compression fittings that engage and lock conduit 14 to floating member 20. Where removable and resizable couplings are used, it will be understood that conduit 14 may be provided in different diameters, so to cooperate with different cans, simply by replacing conduit 14, or, if necessary, swapping both conduit 14 and the couplings for other suitable combinations. While a few coupling methods are described, it will be apparent that there exist a myriad of appropriate coupling techniques in the more general joints and fittings technologies too numerous to individually enumerate herein.

Select-a-Spray nozzle 1 may be manufactured from a variety of materials, including metals, resins and plastics, ceramics, or even combinations or composites. The specific material used may vary, though the materials selected should be suitably solvent resistant to remain compatible with both the contents of the spray can 50 and any cleaning solvents that may be used to clean nozzle 1. The most preferred materials for the major components are polymers, which may or may not include various reinforcing fibers or particles, and other ingredients known to enhance the properties and characteristics of the composition and resulting product. The use of polymers permits volume manufacturing of suitable and relatively complex piece part geometries at relatively low cost using known techniques. Furthermore, there are a number of polymers that are resistant to nearly all solvents.

A variety of designs have been contemplated for Select-a-Spray nozzle 1, and so are not limited to the purely utilitarian appearance illustrated herein. Simulations or fantasy creations may be incorporated into the exterior appearance of the preferred Select-a-Spray nozzle 1 as desired, and the materials and colors used for a particular design may be chosen not only based upon factors such as ease of manufacture and chemical resistance, but may also factor in the particular design.

A second preferred embodiment Select-a-Spray nozzle 100 is illustrated in FIGS. 7-10. Can coupling ring 130 is from an exterior view very similar to can coupling ring 30, and includes alignment labels or indicia which indicate the "off", "Manual" and "Automatically On" positions. While can coupling ring 130 is externally visually similar to can coupling ring 30, the interior has been designed to receive, in order, floating member 120 and selector guide ring 140. Selector guide ring 140 preferably has an outside diameter that will fit securely within the inner diameter of can coupling ring 130, and may form an interference fit therewith, so that it might be press-fit into place and might optionally be removable therefrom for cleaning or other purposes. In this instance, a small lip 133, visible in FIG. 8, may be provided on the inner diameter 135 of can coupling ring 130. This lip 133, which has a slightly smaller inside diameter than inner diameter 135, may act as a retainer for selector guide ring 140, and may also serve to couple positively with a paint can. Alternatively, selector guide ring 140 may be glued, ultrasonically welded, or otherwise bonded to can coupling ring 130 to securely capture floating member 120 between selector guide ring 140 and can coupling ring 130.

Floating member 120 has a finger grasping taper 121 that rises to and terminates at raised members 122, 123. Distal to raised members 122, 123 are three pins, two of which are labeled 124 and 125, the third which is not visible but will be understood in the preferred embodiment to be equidistantly spaced about center spray conduit 14. While three pins are used in the preferred embodiment at 120 degree angles about conduit 14, it will be understood herein that fewer and more pins may be used, and that the specific spacing and geometry of the pins is not critical to the proper operation of the present invention.

Figure 7:
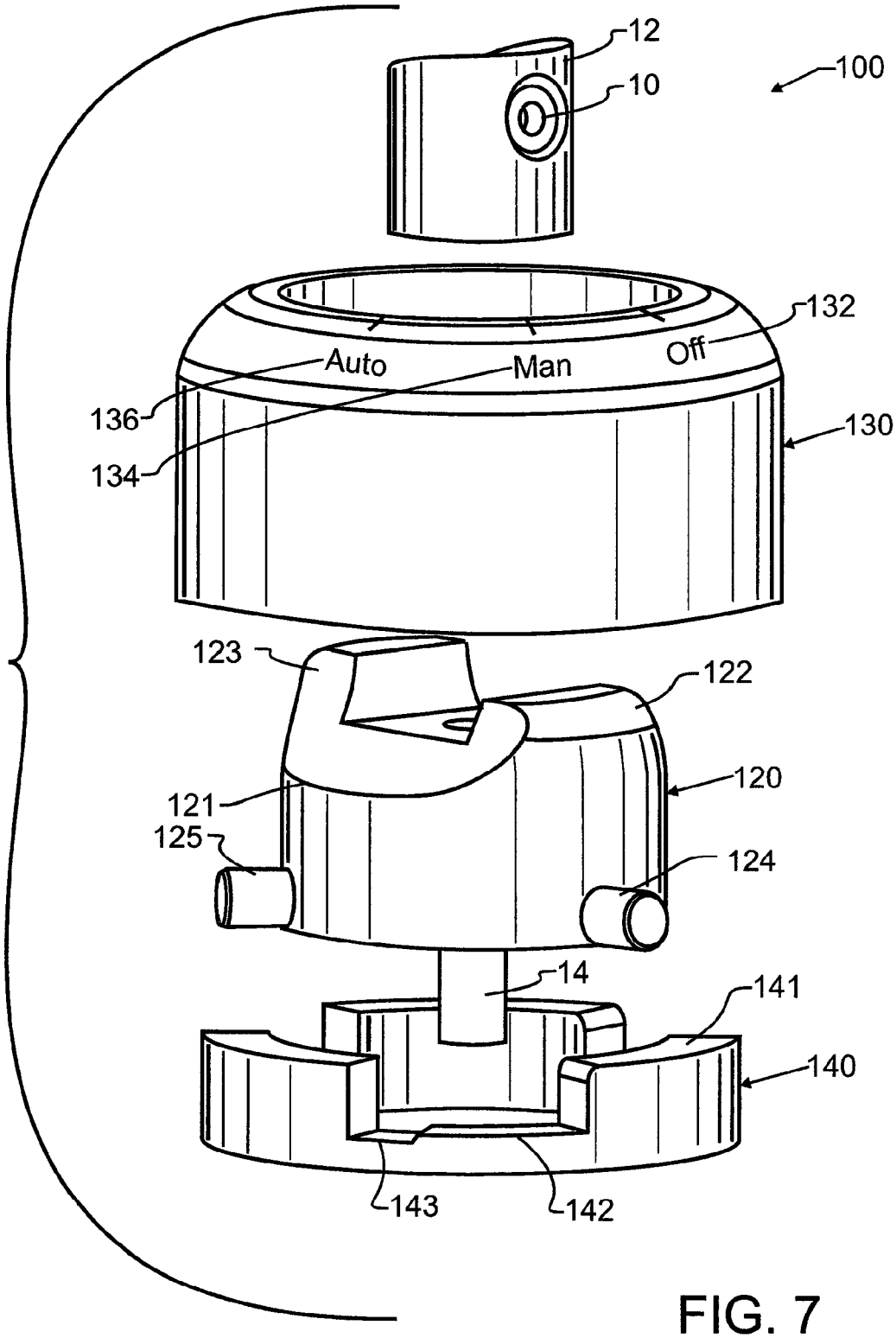
FIG. 7 illustrates a second preferred embodiment spray nozzle operable with a modern paint can which has been designed in accord with the teachings of the invention, from an exploded and slightly projected view.

Also visible in FIG. 7 is the shaped upper surface of selector guide ring 140. The three pins including pins 124, 125 slide upon upper surfaces 141, 142, 143 of selector guide ring 140. Large raised ledge 142 serves as a slide upon which pin 124 is free to slide. When so engaged, pin 124 rests upon ledge 142 and is within the inside wall of can coupling ring 130, and is also below a similar surface within can coupling ring 130, as will be explained further herein below with regard to FIG. 8. Pin 125 will also preferably be resting upon a similar slide, as will the third pin.

When Select-a-Spray nozzle 100 is fully assembled, finger grasping taper 121 will most preferably be entirely above can coupling ring 130. Nozzle 10 will preferably be aimed in the direction of and above raised member 122, and will be affixed with floating member 120 to move therewith. A person using Select-a-Spray nozzle 100 will then comfortably be able to grasp taper 121 and a like taper opposite thereto between finger and thumb, if so desired, and spin floating member 120 relative to can coupling ring 130. The relative rotational movement between floating member 120 and can coupling ring 130 will also mean relative movement between floating member 120 and selector guide ring 140. This means that by grasping the convenient taper 121, a person may simply spin pins 124, 125 relative to the slide surfaces 141, 142, 143 of selector guide ring 140.

Figure 8:
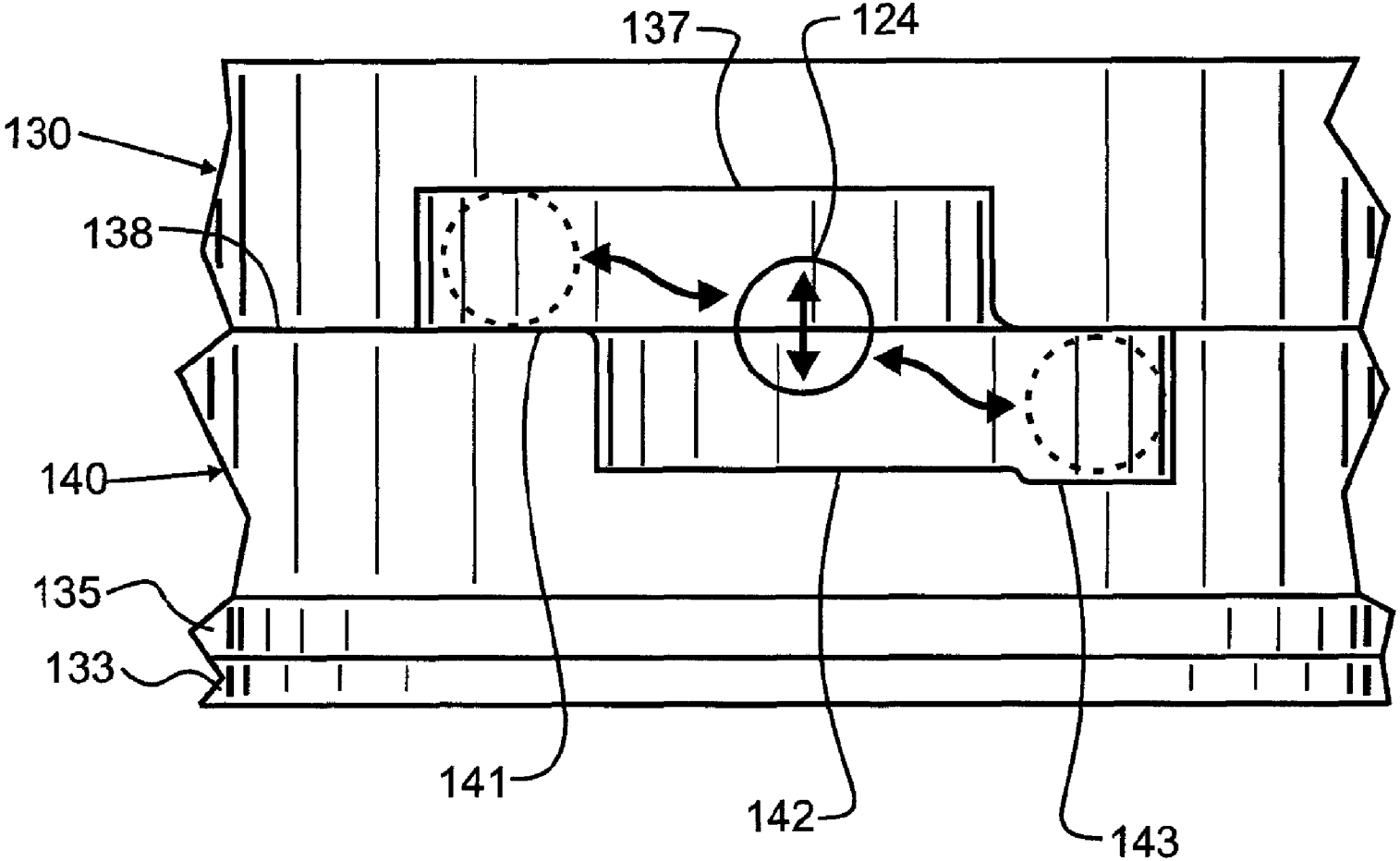
FIG. 8 illustrates the internal guide formed in the second preferred embodiment spray nozzle of FIG. 7 from an interior sectional view looking from adjacent central conduit 14 looking outward therefrom, and with the features of the floating member removed except for a single pin.
Figure 9:
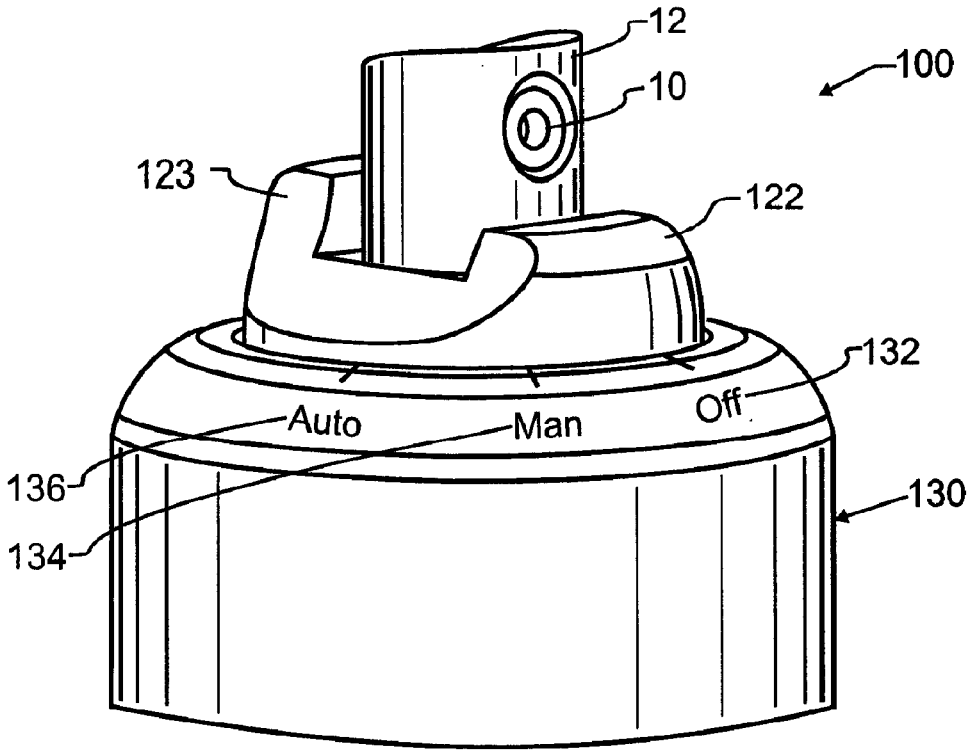
FIG. 9 illustrates the second preferred embodiment spray nozzle of FIG. 7 from an assembled side and slightly projected view.

With singular reference to pin 124, top surface 141, middle surface 142, and lower surface 143, and with specific illustration of FIG. 8, but understanding that the same will apply to each of the three pins, pin 124 will be held up and away from a spray can 50 while pin 124 rests on top surface 141. In this position, pushbutton 12 may not be depressed, since pin 124 is firmly engaged with top surface 141. As floating member 120 is rotated, pin 124 will slide off of top surface 124 and pass adjacent to middle surface 142. However, since middle surface 142 is preferably designed to be lower than the activation threshold of spray can 50, the valve within spray can 50 will urge conduit 14 away from can 50, and therefore will also urge pin 124 away from middle surface 142. However, ordinary manual pressure upon pushbutton 12 will activate the valve internal to spray can 50, causing paint to pass through conduit 14 and out nozzle 10. Reference may be had to both FIGS. 7 and 8 to fully appreciate the relative movement of pin 124 with respect to can coupling ring 130 and selector guide ring 140.

Further rotation of floating member 120 will next move pin 124 adjacent to lower surface 143. However, in this case there is an internal ledge within can coupling ring 130, identified as ledge 138 in FIG. 8, which pushes pin 124 firmly adjacent to lower surface 143. As will be appreciated, this also causes conduit 14 to drive downward into spray can 50, thereby preferably fully opening the valve to spray a continuous stream of paint from nozzle 10. In this position, a person need not apply pressure to pushbutton 12 to spray paint from nozzle 10, enabling automatic spraying. As can be seen in FIG. 8, raised cavities 137 are preferably provided in can coupling ring 130 to accommodate the passage of pin 124 in the manual or off positions, and ledge 138 preferably ensure activation in the auto position adjacent lower surface 143. Further, ledge 138 in combination with the end of lower surface 143 distal to middle surface 142 ensures that pin 124 does not rotate farther than the "auto" position identified by label 136. In the opposite direction of rotation, ledge 138 in combination with top surface 141 ensures that pin 124 does not rotate farther than the "off" position designated by label 132.

The geometry of floating member 120, can coupling ring 130 and selector guide ring 140 inherently form the preferred cavities within which pins 124, 125 may travel. The specific geometry for those cavities may be different from that which is illustrated herein, and so may include slopes that gradually increase spray amounts or the like, if so desired, similar to that illustrated in Select-a-Spray nozzle 1 of FIG. 4, or may instead be fully off, fully on and manually adjustable therebetween, as shown in this embodiment Select-a-Spray nozzle 100.

Both Select-a-Spray nozzle 1 and Select-a-Spray nozzle 100 provide manual access to both the stationary and rotating components, so that should there be any tendency for binding therebetween, the Select-a-Spray nozzles designed in accord with the teachings of the present invention may easily be twisted, thereby ensuring proper operation and spray adjustment. Assembly is particularly facilitated in Select-a-Spray nozzle 100, comprising stacking and pressing together proper components, with, optionally, bonding between selector guide ring 140 and can coupling ring 130. When selector guide ring 140 is interference fit into can coupling ring 130, the parts may be designed to facilitate later disassembly and separation for cleaning, and subsequent to the cleaning, reassembly.

Figure 10:
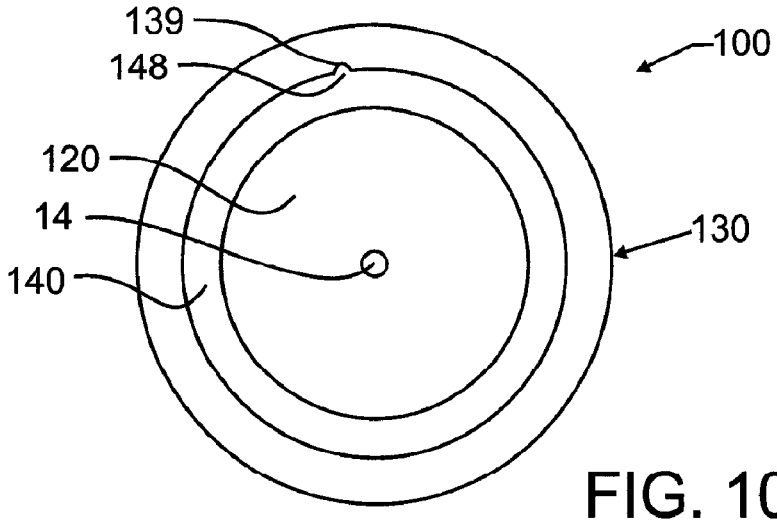
FIG. 10 illustrates the second preferred embodiment spray nozzle of FIG. 7 from a bottom view.

To ensure proper alignment between can coupling ring 130 and selector guide ring 140, particularly in the instance of a press-fit therebetween, an alignment feature may be provided. While there are many which are known in the mechanical arts, FIG. 10 illustrates one suitable approach, which includes a small groove 139 running vertically along the interior of can coupling ring 130, and a small protrusion formed on the outer vertical wall of selector guide ring 140. Protrusion 148 will preferably align with and engage into groove 139, and thereby both ensure alignment, and also prevent rotation therebetween.

The placement of nozzle 10 above the Select-a-Spray nozzles 1, 100, and the tapering of the nozzles 1, 100 down and away therefrom, ensures that any splatter that might be emitted from spray cans does not undesirably coat and contaminate Select-a-Spray nozzles 1, 100. The raised members 122, 123 in Select-a-Spray nozzle 100 provide convenient directional guidance as well, where nozzle 10 is aligned axially with a line these raised members.

While the foregoing details what are felt to be the preferred and additional alternative embodiments of the invention, no material limitations to the scope of the claimed invention are intended. The variants that would be possible from a reading of the present disclosure are too many in number for individual listings herein, though they are understood to be included in the present invention. As but one example, the preferred embodiment illustrates a guide pin 24 extending from floating member 20 into indexing groove cut into can coupling ring 30. However, it will be apparent that the guide pin could equivalently extend from can coupling ring 30 into an indexing ring cut into floating member 20. Consequently, features and design alternatives that would be obvious to one of ordinary skill in the art are considered to be incorporated also. The scope of the invention is set forth and particularly described in the claims herein below.

I claim:

1. A selectable spray system, comprising:

a spray container;

a fluid and propellant contained within said spray container;

a dispersion nozzle;

a conduit operatively coupling said fluid and propellant to said dispersion nozzle;

a valve variably restricting the flow of said fluid and propellant from within said spray container to said dispersion nozzle, said valve operatively controlled through displacement of said conduit relative to said spray container;

a can coupling ring having an outer perimeter and an interior surface defining an interior space, said can coupling ring coupling rigidly to said spray container;

an index fixedly engaging said conduit and being adjustable in a distance from said spray container to thereby control said valve to adjust said flow, said index floating relative to said spray container sufficiently to accommodate minor misalignment therewith and permit said conduit to couple with said spray container independent of said minor misalignment, said index circumscribed by said can coupling ring;

at least one index pin protruding radially from said index;

a selector guide ring affixed to said can coupling ring; and at least one gap defined between said selector guide ring and said can coupling ring capturing said pin and thereby limiting changes in distance between said index and said can coupling ring, said gap extending through an arc about said conduit and having at least two distinct distances from said spray container along said arc.

2. The selectable spray system of claim 1, further comprising a first ledge formed by a notch in said can coupling ring and thereby defining a first limiting surface of said at least one gap.

3. The selectable spray system of claim 2, further comprising a second ledge formed by a notch in said selector guide ring and thereby defining a second limiting surface of said at least one gap.

4. The selectable spray system of claim 3, wherein said first and second ledges are at different angular locations from each other about said conduit.

5. The selectable spray system of claim 3, wherein said first and second ledges are of approximately equal arc length, but are angularly offset from each other.

6. The selectable spray system of claim 1, wherein said index is captured between said selector guide ring and said can coupling ring.

7. The selectable spray system of claim 1, wherein said selector guide ring is interference-fit within said can coupling ring and is operatively non-destructively removable therefrom, whereby said can coupling ring, index, and selector guide ring may be fully separated from each other for cleaning and may be reassembled subsequent to said cleaning.

8. The selectable spray system of claim 1, wherein said selector guide ring is circumscribed by said can coupling ring.

9. The selectable spray system of claim 8, wherein said selector guide ring is located between said spray container and said index.

10. The selectable spray system of claim 1, wherein said can coupling ring comprises indicia identifying at least three available operational modes, including a locked-off position wherein said index cooperates with said valve to prevent said flow, a manual mode position wherein said index cooperates with manual pressure applied to said selectable spray system to vary said flow proportionately to said manual pressure, and an automatic mode position wherein said index cooperates with said valve to permit said flow.

11. The selectable spray system of claim 10, wherein said floating index further comprises guide indicia indicating a direction of spray emanating from said dispersion nozzle, said guide indicia movable to align with any of said can coupling ring operative indicia.

12. The selectable spray system of claim 1, wherein said floating index is generally concentric about said conduit, and with a portion of said conduit extending longitudinally out from said floating index for coupling with said spray container.

13. The selectable spray system of claim 1, wherein said at least one pin has sufficient clearance within said gap to permit said floating index to move up, down and angularly with respect to said can coupling ring to compensate for manufacturing tolerances and other misalignments that might arise between said spray container and said floating index and said conduit.

14. The selectable spray system of claim 1, wherein said floating index further comprises a pushbutton cooperative with said floating index and said valve to open said valve when said index is aligned to permit said flow and cooperative with said index and said valve to prevent said flow when said index is aligned to prevent said flow.

15. The selectable spray system of claim 14, wherein said dispersion nozzle is mechanically supported by said pushbutton.

16. The selectable spray system of claim 1, wherein said dispersion nozzle serves as the termination of said conduit, and said conduit is inserted partially into said spray container and moved to activate said valve to release spray from said spray container, and said conduit will additionally transport paint and propellant to said nozzle for spraying or dispersion therefrom.

17. A spray valve operative with a fluid containing, propellant charged container to control the dispensing of said fluid therefrom, having a first locked state preventing unintentional release of said fluid and propellant and a second state controlling said dispensing of said fluid, comprising:

a press-fit base which is rigidly snapped onto a top of said container;

a dispensing conduit coaxially aligned with a height of said container and concentric with said press-fit base;

a selector guide ring rigidly press-fit into said press-fit base and having a plurality of ledges on a surface distal to said container top;

a plurality of ledges formed into said press-fit base, generally complementary to said selector guide ring ledges and slightly displaced angularly about said dispensing conduit, said press-fit base ledges and said selector guide ring ledges defining a plurality of guide paths within said press-fit base;

a plurality of pins operative to traverse said plurality of guide paths; and an alignment disc capturing said dispensing conduit and said plurality of pins for joined movement with each, said alignment disc further rotatable within and captured between said press-fit base and said top of said container, said rotation of said alignment disc in a first direction driving said dispensing conduit into said container and said rotation of said alignment disc in a second direction opposite to said first direction withdrawing said dispensing conduit from said container.

18. The spray valve of claim 17, wherein each one of said plurality of guide paths further comprise first and second terminations at first and second elevations different from each other, said each one of said plurality of guide paths having a vertical distance through a majority of a range between said first and second terminations operative to precisely position said dispensing conduit at one elevation between said first and second elevations dependent upon a relative rotation between said alignment disc and said press-fit base, and a vertical expansion of each one of said plurality of guide paths having a vertical distance extending from said first elevation to said second elevation.

19. The spray valve of claim 18, wherein positioning said plurality of pins adjacent said first elevation causes said dispensing conduit to drive into said container sufficiently to fully activate said dispensing of said fluid, and wherein positioning said plurality of pins adjacent said second elevation withdraws said dispensing conduit from said container sufficiently to prevent said dispensing of said fluid.

20. The spray valve of claim 17, further comprising an alignment feature in said selector guide ring and an alignment feature in said press-fit base engageable with said selector guide ring alignment feature.

* * * * *